US006029731A

United States Patent [19]

Brazell

[11] Patent Number: 6,029,731

[45] Date of Patent: Feb. 29, 2000

[54] ENHANCED FACING SURROUND ASSEMBLY

[76] Inventor: David O. Brazell, 21400 Via Del Lobo, Yorba Linda, Calif. 92887

[21] Appl. No.: 09/006,466

[22] Filed: Jan. 13, 1998

Related U.S. Application Data

[63] Continuation-in-part of application No. 08/800,500, Feb. 14, 1997, Pat. No. 5,718,272

[60] Provisional application No. 60/011,797, Feb. 14, 1996.

[51] Int. Cl.[7] ..... E04F 10/00

[52] U.S. Cl. ..... 160/39; 160/352; 160/DIG. 9

[58] Field of Search ..... 160/39, 38, 19, 160/31, DIG. 9, 84.06, 23.1, 133, 271, 273.1, 268.1, 172 R, 172 V, 114, 352; 126/544, 546, 547, 548, 551

[56] References Cited

U.S. PATENT DOCUMENTS

| | | | |
|---|---|---|---|
| 2,604,157 | 7/1952 | Gaetano | 160/DIG. 9 |
| 2,958,378 | 11/1960 | Rubens | 160/19 |
| 3,077,923 | 2/1963 | Hatcher | 160/39 X |
| 3,469,570 | 9/1969 | Wright | 126/544 X |
| 3,818,891 | 6/1974 | Dew | 160/DIG. 9 |
| 4,095,582 | 6/1978 | Edwards | 160/DIG. 9 X |
| 4,827,902 | 5/1989 | Rinker et al. | 126/548 |
| 4,913,131 | 4/1990 | Petersen | 126/544 |
| 4,974,658 | 12/1990 | Komatsu et al. | 160/264 X |
| 5,067,540 | 11/1991 | Besler | 160/31 |
| 5,609,196 | 3/1997 | Kraler | 160/323.1 X |
| 5,718,272 | 2/1998 | Brazell | 160/39 |

*Primary Examiner*—David M. Purol
*Attorney, Agent, or Firm*—Owen J. Bates

[57] ABSTRACT

This facing surround assembly is provided which can be installed without fabrication in the field by a single person with average hand tool skills. The facing surround is generally made of non-combustible material and is generally used in conjunction with a fireplace or other wood/gas burning appliance. The invention consists of two corner members, one or more horizontal headers, zero or more corner miters, and two vertical support members positioned. Any particular configuration of the facing can accommodate range of openings.

5 Claims, 10 Drawing Sheets

ENHANCED FACING SURROUND ASSEMBLY

CROSS REFERENCES

This application is a continuation-in-part application and claims the benefit of U.S. Provisional Application No. 60/011,797 filed on Feb. 14, 1996 and U.S. patent application Ser. No. 08/800,500 filed on Feb. 14, 1997, now U.S. Pat. No. 5,718,272.

TECHNICAL ASPECTS OF THE INVENTION

This invention relates primarily to factory-built surround facing systems generally suitable for providing a non-combustible, safe, and easily installed surround, typically for factory-built fireplaces and vented decorative gas appliances or other purposes in which a decorative non-combustible surround assembly can be used. This invention, which can be sculptured, painted or patterned and manufactured of non-combustible material, offers a superior method of providing an esthetic, functional, and easily installed alternative to the traditional materials of brick, tile, marble and other similar materials. This invention incorporates a method of adjustment in a factory-built packaged surround that allows this single package to fit a wide range of sizes and styles of fireplace, appliance or other openings which is easily installed with standard hand tools and without cutting in the field.

BACKGROUND OF INVENTION

The area around a fireplace opening is usually surfaced with non-combustible natural materials, such as brick or tile. This non-combustible area is generally referred to as a surround or facing. A surround is generally thought of as providing an aesthetic or decorative enhancement that compliments or accents the room decor. The surround has a functional purpose as well. The surround or facing, provides a non-combustible protective area around the fireplace opening which serves as a safety zone, isolating normal combustible building materials from the heat and flames emanating from the fireplace opening. Most of the traditional non-combustible materials are installed by specialized tradesmen that possess the skills of applying these materials to surfaces around a fireplace opening. When installed around an actual fireplace or any location where the invention might be exposed to excessive heat or flames, the invention would be manufactured of non-combustible materials. However, when installed for purely decorative purposes, the invention can be made from many other materials.

Traditional materials, such as tile or brick, are very labor intensive to install, because there are a number of individual pieces that must be handled and installed. In addition, there is a high degree of training and experience needed to install these natural materials in a competent and aesthetic manner. The task is complicated because of the large number of pieces that must be precisely aligned on the installation surface in both the vertical and horizontal planes. Further, the traditional materials are heavy and are prone to breakage both during transport and installation. There is a need for an invention that would provide a modular substitution for the traditional materials and methods. The invention would have to be easy to assemble and install by lay persons who possess a basic knowledge of hand tool use. Complete packaging would make it much easier to inventory, store and transport without the traditional breakage and space required by traditional materials. The invention would often be installed in conjunction with factory-built metal fireplaces and factory-built decorative gas appliances. The installation of the invention requires many of the same skills as those that are required to assemble and install fireplaces and appliances. Thus, the same workmen who are installing the fireplace or appliance could also install the invention, eliminating the need to hire and schedule an additional crew of workmen.

An earlier embodiment of this invention, described in U.S. patent application Ser. No. 08/800,500, was a significant advance over previous methods. However, the embodiment as described previously required assembly of the whole surround and then installation around the opening, which often was awkward for one person and was most efficiently performed by two people. In addition, the previous embodiment did not include a means to handle exposed corners that would be found on free standing or peninsula-type fireplaces.

OBJECTS OF THE INVENTION

The invention is an enhancement of an earlier embodiment of this invention. Though the general objectives of the instant invention are the same, the enhancements of the instant invention provide for easier installation and greater flexibility in the type of openings that the invention is suitable for.

As for the previous embodiment, the instant invention provides a solution to a number of deficiencies in the use of traditional materials and methods of constructing surrounds. Several objectives are achieved by this invention. First, it provides a fireplace/appliance facing surround that can be easily assembled and installed. Second, it provides for adjustment in a horizontal and vertical direction so that the final assembly will fit a wide range of sizes of front and corner open fireplaces, appliances and other openings. By using a standard configuration, such that only three pieces need to have varying lengths, it is possible to accommodate a wide range of fireplace or appliance sizes and styles or other openings. Third, the need to modify the adjacent wall structure, beyond that required for the fireplace/appliance, is eliminated. Additionally, the invention can be manufactured to mimic the appearance of many natural materials used for facings and thus the invention can be made to accommodate a wide range of decors. In addition, all mounting fasteners and hardware are hidden from view after installation, thus additionally enhancing its visual appeal.

A further object of the invention, is that it is equally suitable for both retro-fitting as well as new installations. Factory-built fireplaces and appliances are normally installed within conventional combustible framing. The adjacent finished wall surfaces are traditionally installed so that their surfaces are flush with the fireplace/appliance front black faces. For an existing installation where traditional materials have been installed, removing these existing materials is necessary and any slight damage to the wall surfaces will normally be covered by the newly installed invention.

With new installations, the finished wall surfaces need only be prepared as they would be when applying traditional materials. The proper installation of the invention requires that the adjacent wall surfaces be flush with the fireplace/appliance front facing, which is the same requirement as for traditional materials.

With the preceding objectives in mind, all components that are visible after installation, are provided completely finished in the chosen style, finish and color. All additional items, including necessary mounting brackets, necessary assembly and attachment hardware and assembly and installation instructions can be provided in one single carton, packaged to ensure complete protection and ease of handling, inventory and storing.

DESCRIPTION OF INCLUDED DRAWINGS

To provide a more thorough understanding of the invention in addition to illustrating additional details and advantages thereof, reference is now made to the following detailed description along with the accompanying drawings, in which:

FIG. 1 is a perspective view of the assembled front open fireplace/appliance facing surround.

FIG. 1*a* is a perspective view of the lower left hand corner of the facing surround assembly and a portion of the wall and fireplace.

FIG. 2 is a cross sectional view along plane 2—2 as shown in FIG. 1.

FIG. 2*a* is an exploded view of a portion of FIG. 2.

FIG. 2*b* is an exploded view of the Retaining Spring

FIG. 3 is an exploded view of the front open facing surround assembly.

FIG. 3*a* is an exploded view of the Lower Retaining Bracket showing the Aligning Tabs and the Retaining Tab.

FIG. 3*a* is a side view of the Top Cover Retaining Spring.

FIG. 3*c* is a perspective view of the Header Bracket

INSTALLATION OF THE INVENTION

This assembly description details the installation of the preferred embodiment. Other embodiments of the invention, which might incorporate different or modified components, might have different installation instructions. Though reference is made to the use of machine screws and nuts, any number of other attachment devices can be used.

Overview of Installation

As an overview, the two Vertical Support Members 10 and 10' are attached to the surrounding wall and wall support structure and placed parallel to the sides of the fire place opening. Header Panel 11 is aligned horizontally and parallel with the upper edge of the fireplace opening and attached to the surrounding wall and wall support structure.

The Left and Right Corner Blocks 18 and 18' are attached to sleeves 13*a*, 13*b*, 13*a'*, and 13*b'* in order to make the following two assemblies: a) Corner Block 18 and Sleeves 13*a*, 13*b* and b) Corner Block 18' and Sleeves 13*a'*, 13*b'*.

The Corner Block Assemblies are mounted to the wall and wall support structure so that the sleeves of each assembly are placed over the upper portion of one of the Vertical Support Members 10 or 10' and one end of the Header Panel 11.

Detailed instructions are now given below.

Construction of Corner Assemblies

Figure 3:
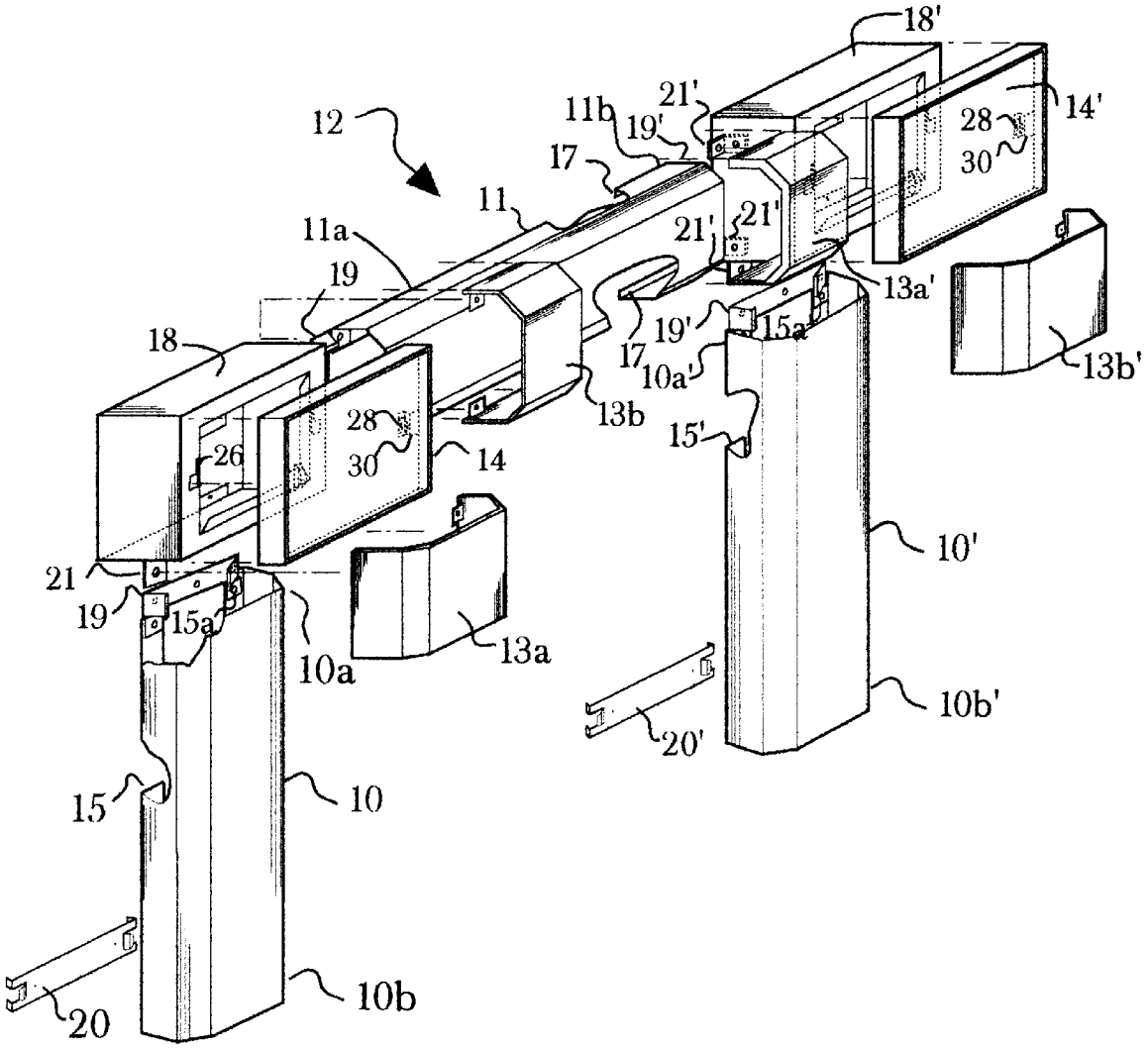

Initially, reference shall be made to FIG. 3. The assembly process begins by attaching four Corner Angles 21 to Left Corner Block 18 and four Corner Angles 21' to Right Corner Block 18'. The Right and Left Corner Blocks 18 ,18' each have four slotted holes, two on one face and a second two on an adjacent face These slotted holes are designed to receive the Corner Angles 21 and 21'. Corner Angles 21 and 21' are small L-brackets with a single hole in each arm of the bracket. Corner Angles 21 and 21' are installed by inserting the first end of Corner Angle 21 or 21' through the slots in the respective Right or Left Corner Block 18 or 18' from inside of Right or Left Corner Block 18 or 18'. Corner Angles 21 and 21' are attached by passing a screw through the Right or Left Corner Block 18, 18' and through the hole in the Corner Angles 21 and 21' and securing with a nut.

Attach all four Sleeves 13*a*, 13*b*, 13*a'*, 13*b'* to the eight Corner Angles 21, 21', typically using No. 8×32 screws and nuts. A machine screw is passed through the hole in the second arm of Corner Angles 21, 21' that is extending through the side of Corner Blocks 18 or 18' and then through holes in small tabs located on each side but only at one end of Sleeves 13*a*, 13*b*, 13*a'* and 13*b'* and secured with a nut. Two assemblies have now been constructed, one consisting of Corner Block 18 and Sleeves 13*a*, 13*b* and the other consisting of Corner Block 18' and Sleeves 13*a'*, 13*b'*. The sleeves 13*a*, 13*b*, 13*a'*, 13*b'* serve to cover a gap that will exist between the Corner Blocks 18, 18' and the Left End, Header Panel 11*a* and Right End, Header Panel 11*b* and between the Corner Blocks 18, 18' and the Upper Portion, Vertical Support Members 10*a*, 10*a'*. The size of this gap will vary based upon the exact opening for which the Surround 12 is being installed.

The purpose of the Sleeves 13*a*, 13*a'*, 13*b*, 13*b'* is two fold. The first is to provide a smooth visual transition from the Corner Block to either the Header Panel or the Vertical Support Members. The second is to hide the gap that will exist between the Corner Blocks and the Vertical Support Members and between the Corner Blocks and the Header Panel. In this embodiment of the invention, the sleeves come in two types: 13*a*, 13*a'* and 13*b*, 13*b'*. In this embodiment, the outside edge of the sleeve is wider than the inside edge, therefor the sleeve is not symmetrical and not interchangeable.

Vertical Support Members and Header Panel

Then four Header Brackets 19, 19' are attached to the Vertical Support Members 10, 10' at the Upper End, Vertical Support Member, 10*a* and 10*a'* respectively and to Header Panel 11 at Left End, Header Panel 11*a* and Right End, Header Panel 11*b*.

Vertical Support Members 10, 10' have a Flange 15 and Flange 15' respectively, running the entire length of the Vertical Support Member 10 and 10' on each side of Vertical Support Members 10 and 10'. Header Panel 11 also has a Flange 17 running the entire length of Header Panel 11 on each side of Header Panel 11.

The Header Brackets 19, 19' provide a first set of holes located in tabs projecting outward from Header Brackets 19, 19' for engaging Flange 15 and 15' on Vertical Support Members 10 and 10' and Flange 17 on Header Panel 11. Header Brackets 19, 19' are attached to both Vertical Support Members 10, 10' and Header Panel 11, by passing a machine screw through the first set of holes in the projecting tabs, then through the holes in Flanges 15, 15' and 17 and finally secured by a nut. There is a second set of holes in Header Brackets 19, 19' that allow for attachment to the fireplace/appliance face and the surrounding wall and wall support which is performed latter in the installation.

Figure 1:
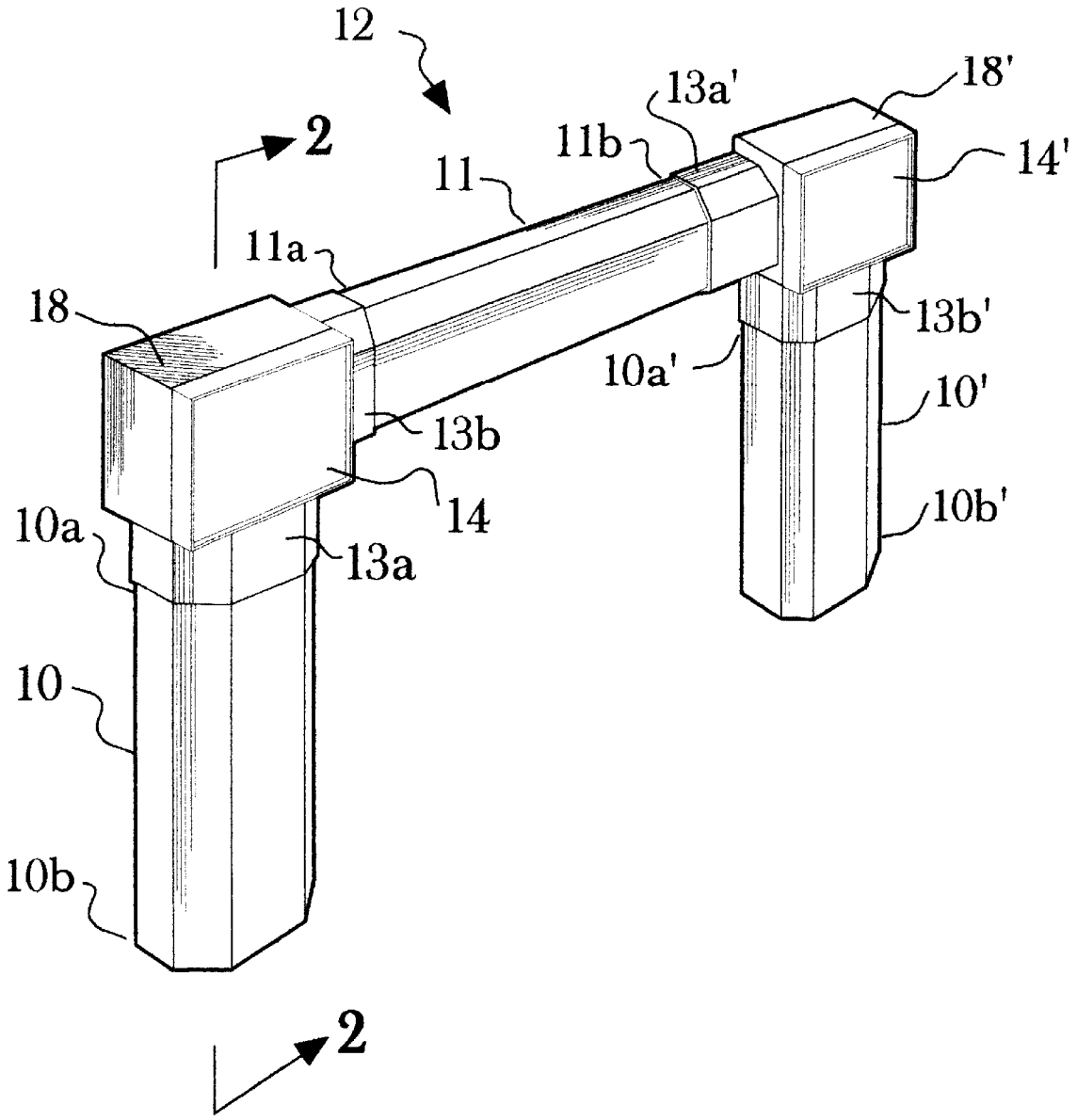
Figure 1A:
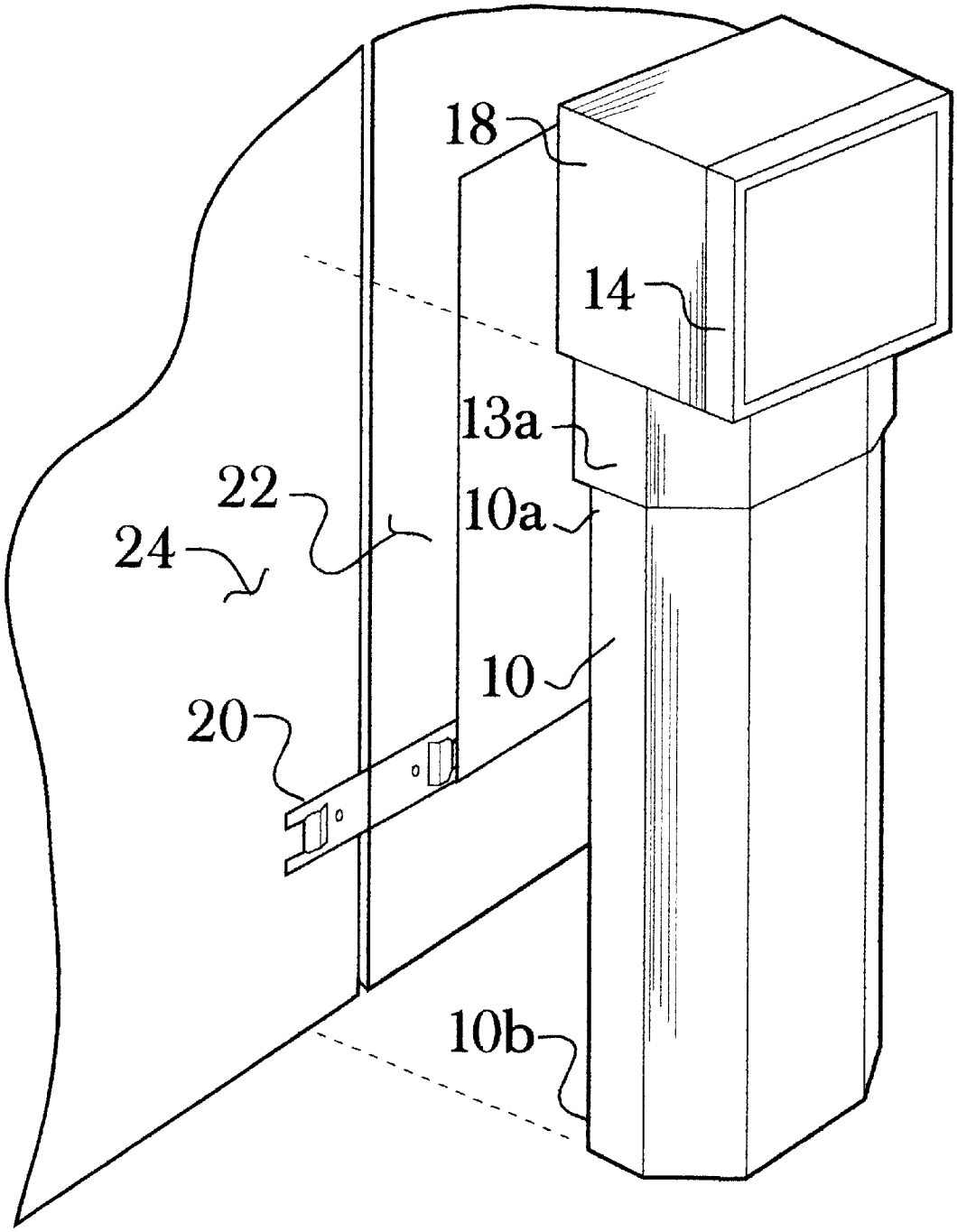

Reference is now made to FIG. 1*a*. The Lower Brackets 20, 20' are now attached to the lower portion of the fireplace or appliance opening. The Lower Brackets 20, 20' are positioned by placing the Aligning Tab 34 which is located at either end of the Lower Bracket 20, 20' against the inside edge of the vertical opening of the fireplace. As an example, if a lower bracket is being position along the left side of the fireplace opening as shown in FIG. 1*a*, the Lower Bracket 20 is placed so that the right hand Aligning Tab 34 extends just past and around the left hand vertical edge of the fireplace opening with the rest of the Lower Bracket 20 resting on the surface surrounding the fireplace opening. Then the Lower Bracket 20 is pulled snugly to the left, hooking the aligning tab 34 on the edge of the fireplace or other opening. The Lower Bracket 20 was designed so that if the proper procedure is followed, the Vertical Support Members 10, 10' will be properly positioned in relation to the rest of the Surround 12 after the Vertical Support Members 10, 10' are held in place by both the Lower Retaining Bracket 20 and the Header Brackets 19, 19'. The Lower Retaining Bracket 20 is now secured to the wall with included hardware. Lower Retaining Bracket 20' is attached in a similar fashion. After the Lower Retaining Brackets 20, 20' have been installed, the Aligning Tabs 34 on each side of Lower Retaining Brackets 20, and 20' are bent back on itself through a 135 degree angle. This alteration of the Lower Retaining Brackets 20, 20' provides clearance for the Vertical Support Members 10, 10' and permits the Aligning Tabs 34 to be hidden from view after the Vertical Support Members 10, 10' have been installed.

For front open fireplaces/appliances, the Header Panel 11 can now be attached to the fireplace/appliance face. As previously described, there is a Header Bracket 19 attached to each end of Header Panel 11. The Header Panel 11 is centered between the fireplace/appliance opening and the Aligning Tabs 35 of each Header Bracket 19 are placed over the top edge of the fireplace/appliance opening. Header Panel 11 is gently raised so that Aligning Tabs 35 are snug against the upper inside edge of the fireplace or appliance opening. Header Brackets 19 and the attached Header Panel 11 are secured to the fireplace/appliance using the provided hardware. All Aligning Tabs 35 can then be bent back through a 135 degree angle. This permits the Aligning Tabs 35 to be hidden from view after the corner block/sleeve assemblies have been attached.

The Vertical Support Members 10, 10' can now be installed. Detailed instructions will be given for Vertical Support Member 10. A similar procedure can be followed for the installation of Vertical Support Member 10'. Insert Lower End, Vertical Support Member 10*b* so that the Flange 15 on each side of Vertical Support Member 10 engages the Retaining Tab 32 located on each side of Lower Retaining Bracket 20. Lower the Vertical Support Member 10 until it rests on the hearth extension or floor surface.

Hook the Aligning Tab 35 on the right side of the Header Bracket 19, which is attached to Vertical Support Member 10, just over the left edge of the vertical fireplace opening and move the Header Bracket 19 and Vertical Support Member 10 assembly to the left until the Aligning Tab 35 is positioned snugly against the left edge of the fireplace opening. Secure the Header Bracket 19 to the surrounding wall and wall support structure using furnished hardware.

The Aligning Tabs 35 can then be bent back through 135 degrees in order to hide the Aligning Tabs 35 from view after the Corner Block/sleeve assembly has been attached. Vertical Support Member 10' can be installed in an analogous manner.

Installation of Corner Assemblies

The right and left Corner Block/sleeve assemblies 18, 13*a*, 13*b* and 18', 13*a'*, 13*b'* are now positioned on their respective sides so that the sleeves are placed over the ends of Header Panel 11 and the Upper Portion, Vertical Support Member 10*a* and Upper Portion, Vertical Support Member 10*a'*. Corner Blocks 18, 18' are attached to the surrounding wall and wall support structure by utilizing standard mounting hardware through mounting holes located on the inside of the Corner Blocks 18 and 18'.

Lastly, each of the two Top Covers 14, 14' are attached to the faces of the Corner Blocks 18, 18' and held in place by engaging the two Retaining Springs 28 on each of the Top Covers 14, 14' within the two Mounting Slots 26 on the face of each of the Corner Blocks 18, 18'. The Retaining Spring 28 provides tension to hold the Top Covers 14, 14' tight against the Corner Blocks 18, 18'.

Corner Miter

Figure 4:
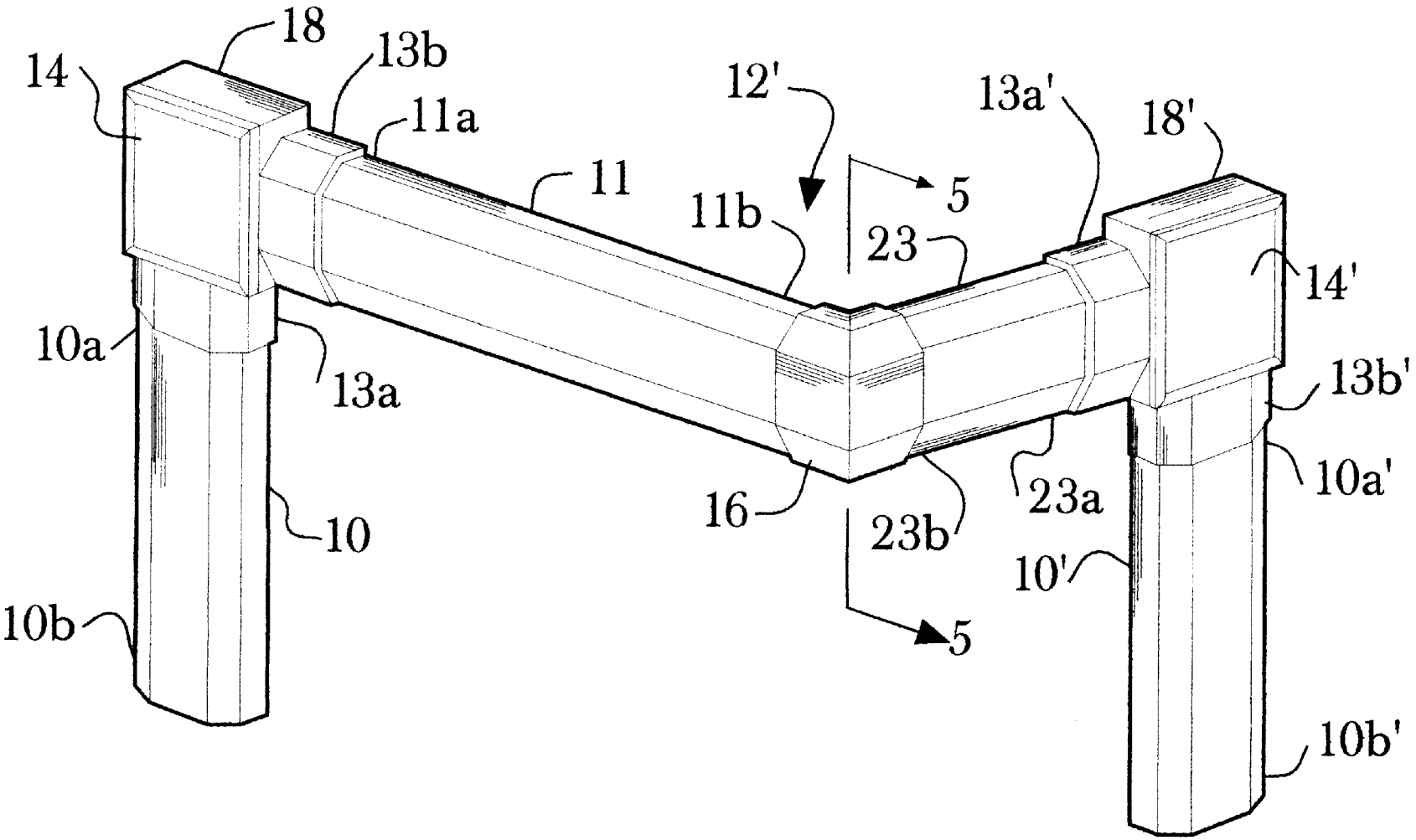
FIG. 4 is a perspective view of the assembled corner open fireplace/appliance facing surround.

In some installations, the fireplace will extend into the room and there will be an external corner. Reference is now made to FIG. 4. A Surround 12' for such a fireplace will require the use of a Corner Miter 16 and a second Header Panel 23. Though in theory, the lengths of Header Panel 11 and Header Panel 23 could be identical, Header Panel 23 is generally much shorter than Header Panel 11. The use of Corner Miter 16 is not dependent upon the relative lengths of Header Panel 11 and Header Panel 23. The lengths of Header Panel 11 and Header Panel 23 are shown in a configuration that is typical for extended fireplaces and appliances.

In overview, Corner Miter 16 is first attached to the fireplace frame, the wall or wall supports. Then one end of Header 11 is inserted into one opening in Corner Miter 16 and Header Panel 23 is inserted into the other opening in Corner Miter 16. The ends of Header Panel 11 and Header Panel 23 not installed in Corner Miter 16 are positioned and attached to the walls in the manner previously described.

Detailed Description of Installation of Corner Miter

Figure 5:
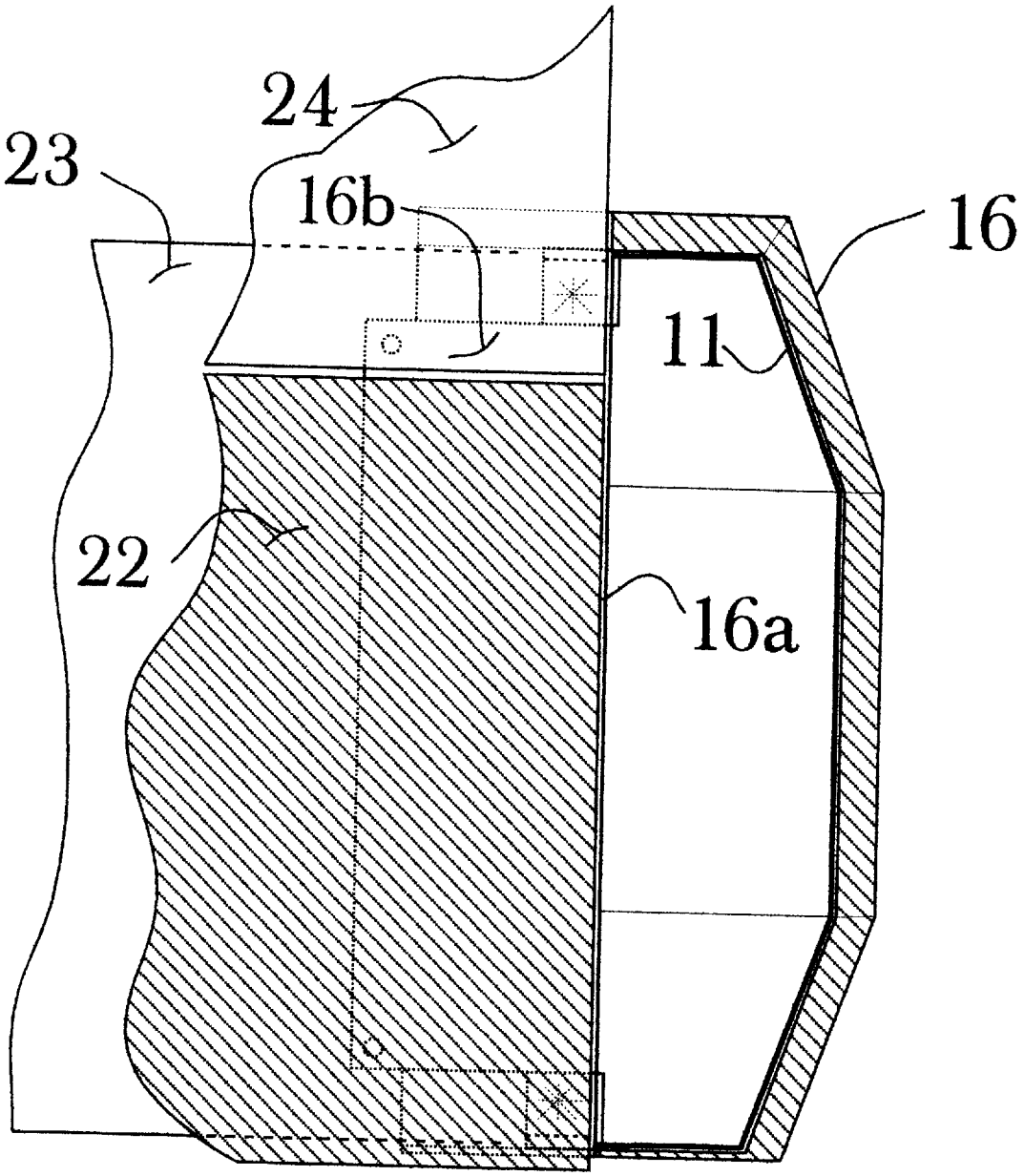
FIG. 5 is a cross sectional view along plane 5—5 as shown in FIG. 4.
Figure 6:
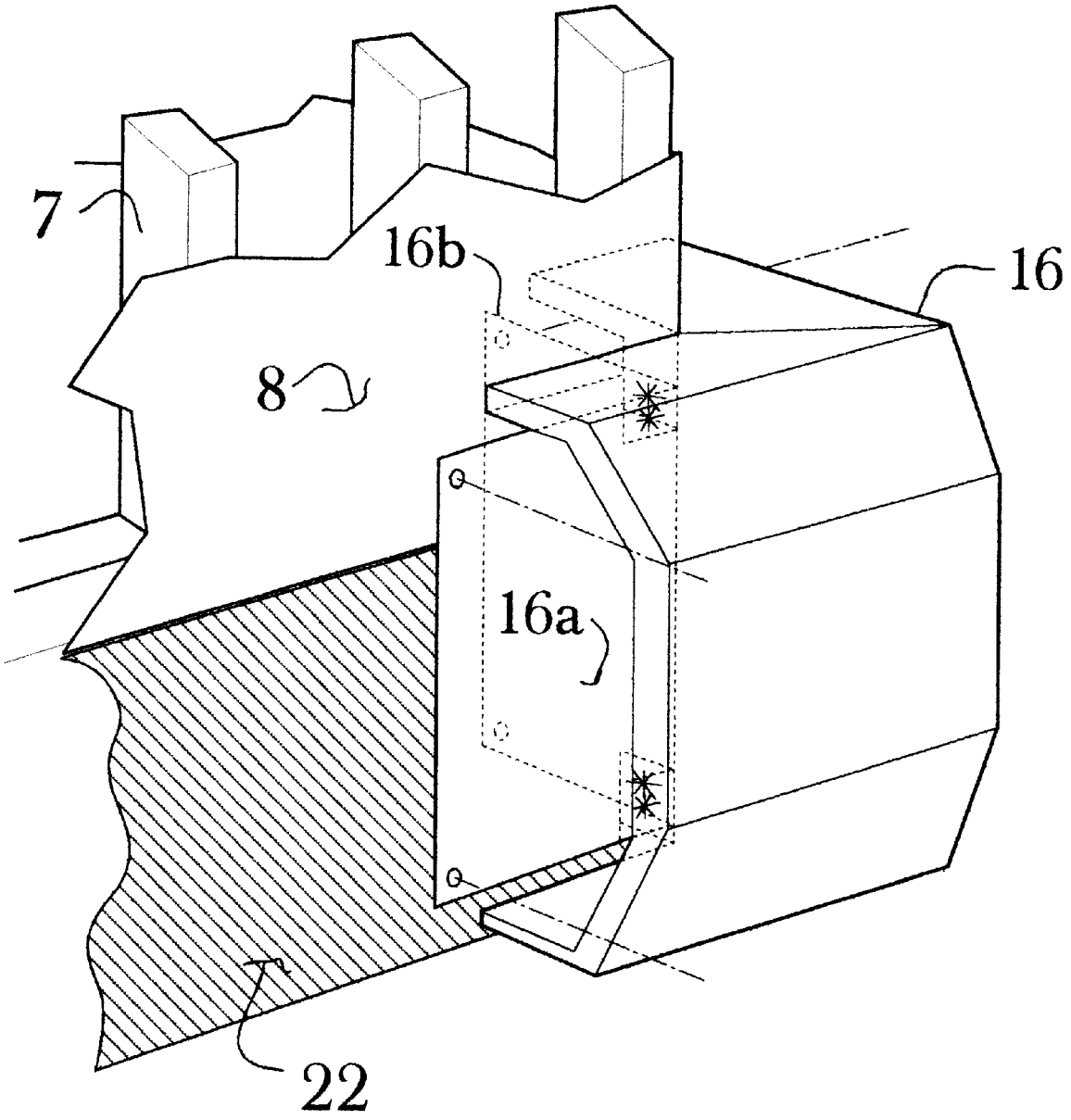
FIG. 6 is a perspective front view of the Corner Miter component and a portion of the wall and fireplace.
Figure 7:
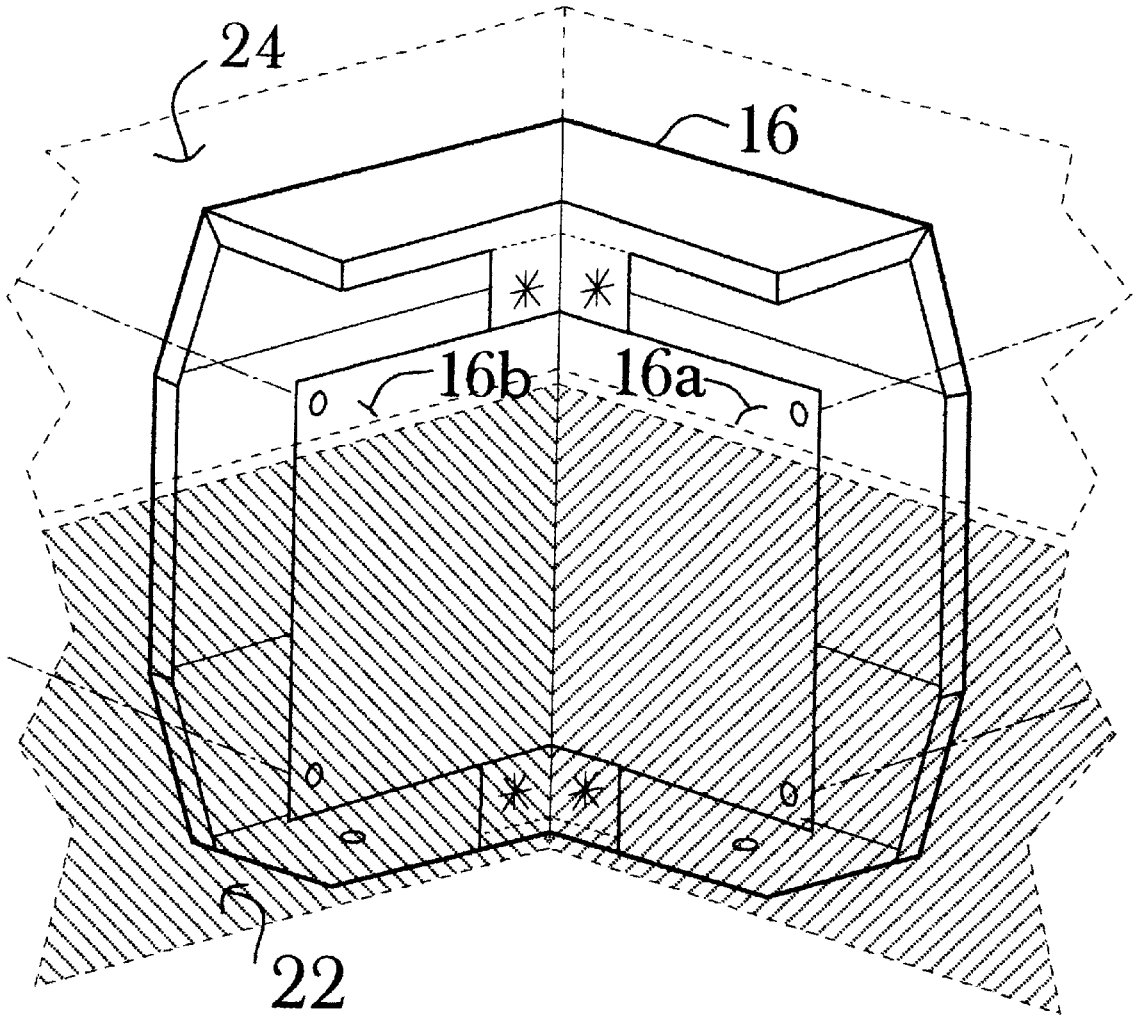
FIG. 7 is a rear perspective view of the Corner Miter component and a portion of the wall and fireplace.

Reference is now made to FIGS. 5, 6, and 7 in order to fully describe the installation of Corner Miter 16. The Corner Miter 16 must first be attached to the fireplace/appliance corner by securing the Miter Flange 16*a* and Miter Flange 16*b* to the surface surrounding the fireplace or appliance with the screws provided. For an installation with an external corner, Surround 12' must utilize headers with one plain end which slides into the Corner Miter 16. A plain end is simply an end of either the Header Panel 11 or Header Panel 23 without a Header Bracket 19 attached. Once positioned and inserted, the opposite end of Header Panel 11 or Header Panel 23 can be aligned by positioning Aligning Tab 35 on Header Bracket 19, as previously described. Header Bracket 19 is secured to the fireplace face/wall using provided hardware. Aligning Tabs 35 are bent back through a 135 degree angle to provide clearance for the remainder of the installation. The rest of the Surround 12' is installed as previously described for Surround 12.

DETAILED DESCRIPTION

An adjustable fireplace surround, hereinafter referred to as a Surround 12, will best be described initially by reference to FIG. 1 which shows fully assembled, one possible configuration of the invention installed on a front open fireplace or appliance. Several important features of the invention are not visible from this view, but will be shown and discussed later in this description. The Surround 12 is shown as it would be viewed from inside a room looking into the fireplace or other opening. Starting from the lower left corner, FIG. 1 shows a Vertical Support Member 10. Positioned at the upper end of the Vertical Support Member 10 is a Sleeve 13*a*. The upper portion of sleeve 13*a* abuts the lower portion of Left Corner Block 18. Positioned on an adjacent face of Corner Block 18 is Sleeve 13*b* which abuts the right hand face of Left Corner Block 18. Top Cover 14 is attached to the outward facing surface of Corner Block 18. Positioned next to Sleeve 13*b* is Header Panel 11. On the opposite side of Header Panel 11 is Sleeve 13*a*', which abuts the left hand face of Right Hand Corner Block 18'. Top Cover 14' is attached to outer face of Corner Block 18'. Sleeve 13*b*' is positioned so that the upper surface of sleeve 13*b*' abuts the lower surface of Right Corner Block 18'. Vertical Support Member 10' is positioned below Sleeve 13*b*' and in contact with Sleeve 13*b*'.

It should be understood that various shapes and configurations shown are not the only possible embodiment of the invention. For example, the Corner Blocks 18, 18' may be a variety of shapes, including but not limited to: hexagonal, oval, oblong or even round and still be within the scope and spirit of the invention. The Top Covers, as shown are rather simple covers, but they could be surfaced in any number of ornamental ways including but not limited to the application of tile or paint images or patterns. The header and vertical support members can be made so that their shapes takes on a variety of contours and textures in order to blend with a wide range of decorating styles.

Figure 2:
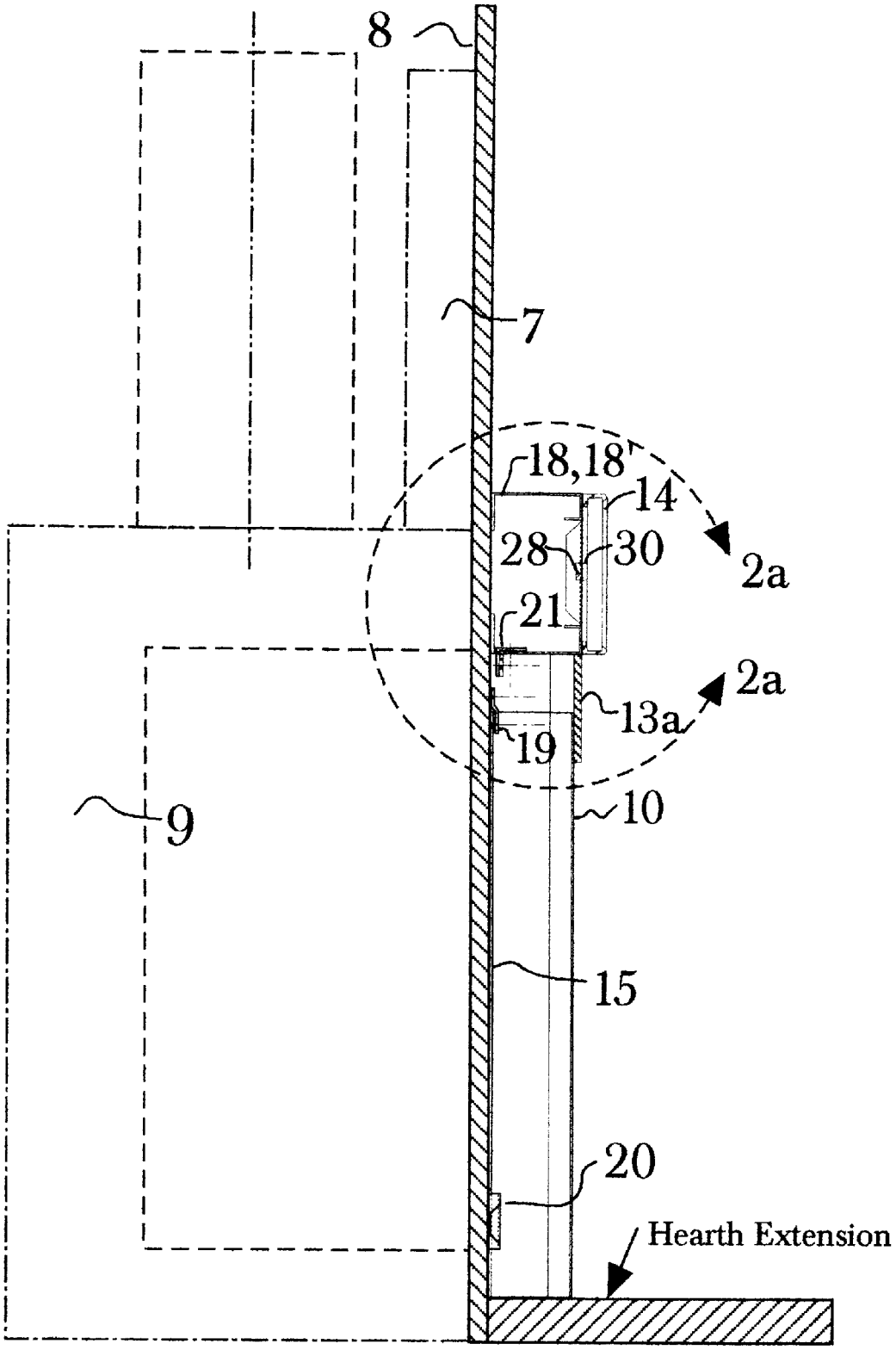

FIG. 2 is a sectional view along plane 2—2 shown in FIG. 1. The fireplace/appliance 9, the Enclosure Wall 8 and Support Framing 7 though not part of the invention, are shown in order to better describe the relationship between the invention and fireplace/appliance.

Starting in the lower portion of FIG. 2, there is shown the Lower Retaining Bracket 20, which is attached to either the Enclosure Wall 8 or to a portion of the Fireplace/Appliance 9 or both. Vertical Support Member 10 has an inward turning Flange 15 running the length of the Vertical Support Member 10 on both sides. The Vertical Support Member 10 is retained by the Flange 15, which engages Retaining Tab 32 on Lower Retaining Bracket 20, which is described in detail later in this application.

Sleeve 13*a* is located at the upper end of the Vertical Support Member 10 and abuts the lower surface of the Corner Block 18 and overlaps the top of portion of Vertical Support Member 10. Sleeve 13*a* is secured to Corner Angle 21. Corner Angle 21 is an L-bracket having two arms. The first arm of Corner Angle 21 is passed through a slot in the body of Corner Block 18 and held securely by a machine screw and nut. The screw passes through a hole in the second arm of Corner Angle 21 and the Corner Block 18 and held in place by a nut. Top Cover 14 is attached to Corner Block 18 by the use of Retaining Springs 28 which engage Mounting Slots 26 in the face of Corner Block 18.

Figure 2A:
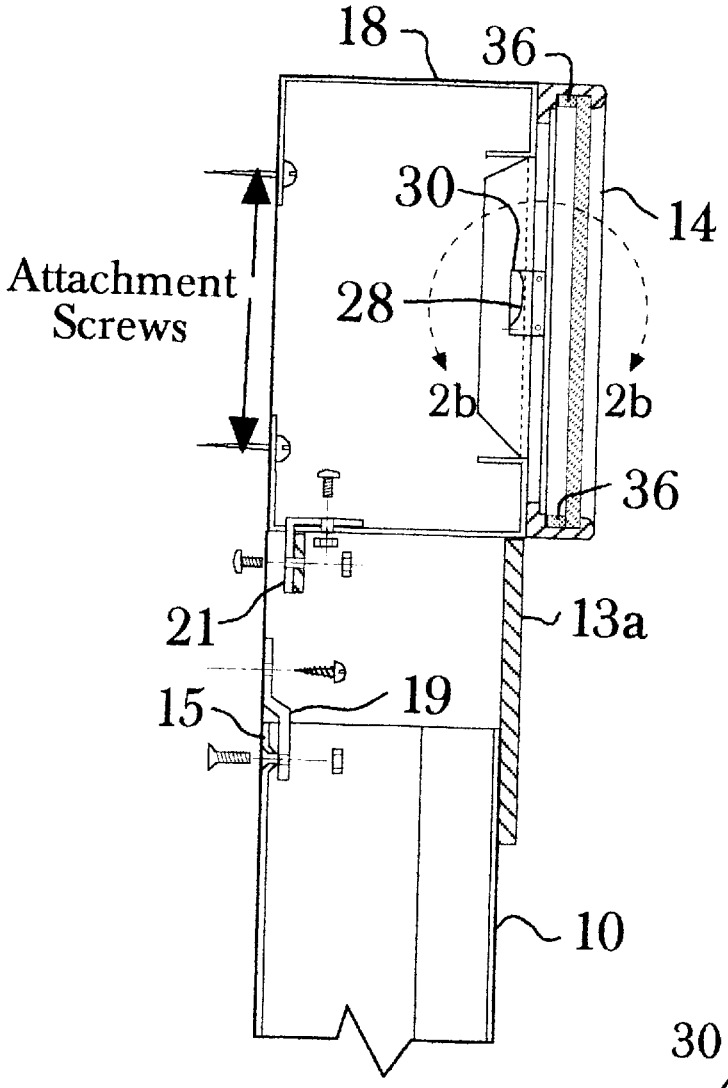
Figure 3A:
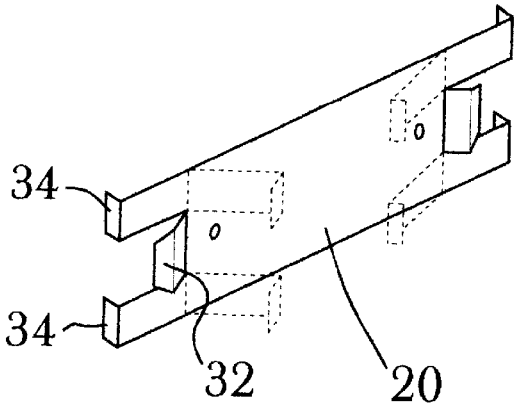

Referring now to FIG. 2*a*, which is an expanded view of a portion of FIG. 2, there is shown Header Bracket 19 (shown in greater detail in FIG. 3*c*) attached to Vertical Support Member 10 by means of attachment hardware passing through Flange 15 and Header Bracket 19. Sleeve 13*a* is shown attached to Corner Angle 21 by means of attachment hardware passing through a hole in the first arm of Corner Angle 21 and through a tab on Sleeve 13*a*.

Retaining Spring 28, mounted on Angle Bracket 30 which is attached to Top Cover 14, is shown in an engaged position with the Top Cover 14 secured to Corner Block 18.

Figure 2B:
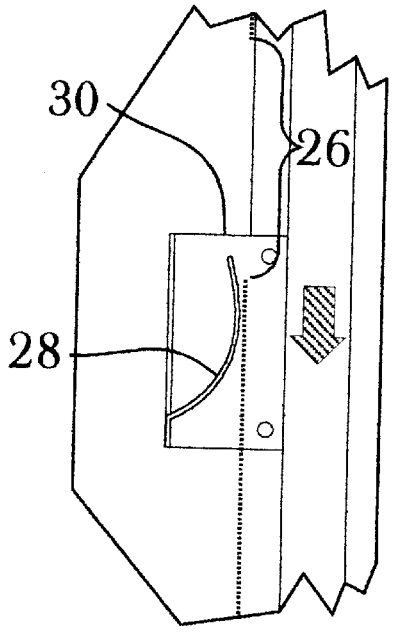

FIG. 2*b* is an enlarged view of a portion of FIG. 2*a* as indicated. Retaining Spring 28 is shown compressed against the inner wall of the Corner Block 18. Retaining Slot 26 is shown as the break in the dotted line in FIG. 3*b*. In FIG. 2*b* the Top Cover 14 is shown fully engaged.

Figure 3B:
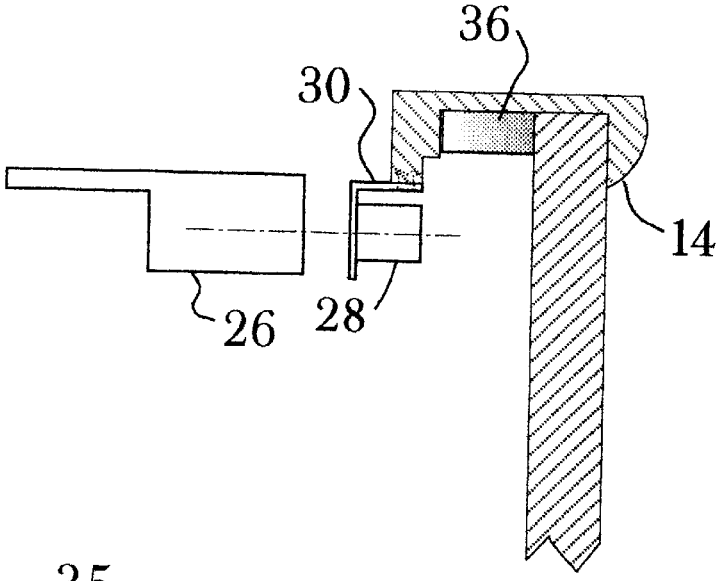
Figure 3C:
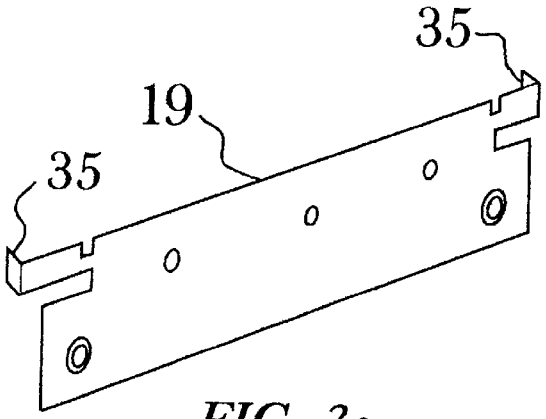

Further details of Retaining Spring 28 and Angle Bracket 30 are shown in FIG. 3*b*. FIG. 3*b* shows Retaining Slot 26 having a rectangular portion with a narrow arm extending along one side of the slot. Top Cover 14 is attached to Corner Block 18 by inserting the free arm of Angle Bracket 30 with Retaining Spring 28 attached into the rectangular portion of Retaining Slot 26 and moving Top Cover 14 in the direction of the extended arm section of Retaining Slot 26. The attached arm of Angle Bracket 30 is accommodated by the extended arm portion of Retaining Slot 26. As Top Cover 14 is moved into position, Retaining Spring 28 is compressed against the inner surface of Corner Block 18 providing a biasing force holding Top Cover 14 securely in place on top of Corner Block 18.

FIG. 3 is an exploded view of the Surround 12. Starting the description in the lower left corner with the Lower Retaining Bracket 20, which is attached near the floor, just to the left of the fireplace opening. The Vertical Support Member 10, has two Flanges 15 which run along the longitudinal axis on each side of Vertical Support Member 10 and are turned in so that once the Vertical Support Member 10 is installed, the Flanges 15 are not visible. The Flanges 15 are engaged in Retaining Tab 32 that are integral with Lower Retaining Bracket 20. The upper portion of Vertical Support Member 10 is attached and secured by machine screws and nuts to a Header Bracket 19. Header Bracket 19 has two holes that are used to attach to Flange 15 of the Vertical Support Member 10 by the use of standard machine screws and nuts. Header Bracket 19 also contains a second set of holes for attaching Header Bracket 19 to the Fireplace/Appliance Face 9 or the Enclosure Wall 8 or Support Framing 7. Vertical Support Member 10 is secured to the Header Bracket by passing a flat headed machine screw through each Flange Hole 15*a* in the Flange 15 on the Vertical Support Member 10 and through the mounting holes on Header Bracket 19 and then engaging with a machine nut. Sleeve 13*a* is secured to a hole in each of the Corner Angles 21 by utilizing two tabs formed on each side of the sleeve 13*a*. Each tab has a single attachment hole. A machine screw is passed through the a hole in the first arm of the first Corner Angle 21, through the a tab in Sleeve 13*a* and secured by a machine nut. This step is repeated for the second Corner Angles 21. Sleeve 13*a* overlaps a portion of Vertical Support Member 10 and abuts the lower surface of Corner Block 18. Top Cover 14 attaches to Corner Block 18 by engaging a pair of Retaining Springs 28 into Retaining Slot 26.

A pair of Corner Angles 21 are attached in the manner previously described to the right hand face of Corner Block 18. Sleeve 13*b* is attached to these corner angles in the manner previously described. Each end of the Header Panel 11 is attached to the mounting holes in two Header Brackets 19 in the manner previously described.

A pair of Corner Angles 21 are attached to the left hand face of Corner Block 18' in the manner previously described. Sleeve 13*a*' is attached to these Corner Angles 21 in the manner previously described.

A pair of Corner Angles 21 are attached to the lower surface of Corner Block 18' in the same manner previously described. Sleeve 13*b*' is attached to the Corner Angles 21 in the manner previously described. The upper end of Vertical Support Member 10' is attached to the mounting holes in Header Bracket 19' in the manner previously described.

FIG. 3*a* shows two ends of Lower Retaining Bracket 20. The Aligning Tabs 34 are used to help locate the lower retaining bracket by placing the hooked ends around the edge of a fireplace/appliance or other opening. After Lower Retaining Bracket 20 has been positioned, it is screwed into place. The Aligning Tabs 34, of which there are four on each Lower Retaining Bracket 20, are bent back through approximately a 135 degree rotation. Thus Aligning Tabs 34 are now positioned so that they do not interfere with other components and permits Vertical Support Members 10, 10' to be placed such that the Flanges 15 and 15' on these items engage the Retaining Tab 32 on Lower Retaining Bracket 20.

FIG. 4 shows a Surround 12' which is an embodiment which accommodates fireplaces/appliances or other openings with exposed corners. Surround 12' uses a Corner Miter 16 and an a second Header Panel 23. The Surround 12' is shown as it would be viewed from inside a room looking into the fireplace or other opening. Starting from the lower left corner, FIG. 4 shows a Vertical Support Member 10. Positioned at the upper portion of the Vertical Support Member 10 is a Sleeve 13*a*. The upper portion of Sleeve 13*a* abuts the lower portion of Left Corner Block 18. Positioned on an adjacent face of Left Corner Block 18 is sleeve 13*b* which abuts the right hand face of Left Corner Block 18. Top Cover 14 is attached to the outward facing surface of Corner Block 18. Positioned next to sleeve 13*b* is the Left End, Header Panel 11*a*. Right End, Header Panel 11*b* is inserted inside one arm of Corner Miter 16. Header Panel 23 has a Left End, Header Panel 23*b* and a Right End, Header Panel 23*a*. Left End, Header Panel 23*b* is inserted into the other arm of Corner Miter 16. Right End, Header Panel 23*a* abuts sleeve 13*a'*, which abuts the left hand face of Right Corner Block 18'. Top Cover 14' is attached to outer face of Corner Block 18'. Sleeve 13*b'* is positioned so that the upper surface of Sleeve 13*b'* abuts the lower surface of Corner Block 18'. Vertical Support Member 10' is positioned below Sleeve 13*b'* and in contact with Sleeve 13*b'*.

A cross section of the Corner Miter 16 is shown in FIG. 5 along with Miter Flanges 16*a* and 16*b*. Corner Miter 16 is shown in relation to the fireplace/appliance and wall. The Miter Flange 16*a* is shown tight against the fireplace/appliance Face 22 and Wall Surface 24.

FIG. 6 shows a perspective frontal view of the Corner Miter 16 and its Miter Flanges 16*a* and 16*b* which are shown tight against the fireplace/appliance Face 22 and Wall Surface 24.

FIG. 7 shows a perspective rear view of the Corner Miter 16 and its Miter Flange 16*a* against the fireplace/appliance Face 22 and Wall Surface 24.

Although preferred embodiments of the invention have been described in the foregoing Detailed Description and illustrated in the accompanying drawings, it will be understood that the invention is not limited to the embodiments disclosed but is capable of numerous rearrangements, modifications and substitutions of parts and elements without departing from the spirit of the invention. Accordingly, the present invention is intended to encompass such rearrangements, modifications of parts and elements as within the spirit and scope of this invention. Even though it has been described primarily as being used in conjunction with a fireplace opening, the invention may equally be used to provide a decorative and/or protective surround for a doorway, archway, window or any other opening.

I claim:

1. An apparatus for surrounding an opening in a surface, comprising:

a) a horizontal header having a first end and a second end;

b) a first alignment means attached to said horizontal header whereby said horizontal header can be aligned with the opening and fixedly attached to the surface;

c) a first and a second vertical support member each having an upper end and a lower end;

d) a second alignment and a third alignment means attached to said pair of vertical support members whereby said vertical support members can be aligned with the opening and fixedly attached to the surface;

e) a first and a second corner member;

f) a first attachment means attached to said first corner member;

g) a second attachment means attached to said first corner member such that said first attachment means and said second attachment means are orthogonal to each other;

h) a first sleeve configured to receive said upper end of said first vertical support member and a second sleeve configured to receive said first end of said header panel and said first sleeve is attached to said first attachment means and said second sleeve is attached to said second attachment means whereby when said first corner member, with said first and said second sleeve attached, is attached to the surface, said first sleeve receives the upper end of said first vertical support member and said second sleeve receives said first end of said horizontal header;

i) a third attachment means attached to said second corner member;

j) a fourth attachment means attached to said second corner member such that said third and said fourth attachment means are orthogonal to each other; and k) a third sleeve configured to receive said second end of said header panel and a fourth sleeve configured to receive said upper end of said second vertical support member and said third sleeve is attached to said third attachment means and said fourth sleeve is attached to said fourth attachment means whereby when said second corner member, with said third and said fourth sleeve attached, is attached to the surface, said third sleeve receives said second end of said horizontal header and said fourth sleeve receives said upper end of said second vertical support member.

2. An apparatus for surrounding an opening in a surface, as described in claim 1 wherein the apparatus is made of non-combustible material.

3. An apparatus for surrounding an opening in a surface having a plurality of faces, comprising:

a) a first horizontal header having a first end and a second end;

b) a second horizontal header having a first end and a second end;

c) a first vertical support member having a first end and a second end;

d) a second vertical support member having a first end and a second end;

e) a first and a second corner member;

f) a first sleeve configured to receive said first end of said first vertical support member;

g) a second sleeve configured to receive said first end of said first horizontal header;

h) a third sleeve configured to receive said second end of said second horizontal header;

i) a fourth sleeve configured to receive said first end of said second vertical support member;

j) a first alignment means attached to said first vertical support member and attached to the surface such that said first vertical support member is aligned with the opening in the surface and attached to the surface;

k) a second alignment means attached to said second vertical support member and attached to the surface such that said second vertical support member is aligned with the opening in the surface and attached to the surface;

i) a third alignment means attached to said first horizontal header and attached to the surface such that said first horizontal header is aligned with the opening in the surface and attached to the surface;

m) a fourth alignment means attached to said second horizontal header and attached to the surface such that said second horizontal header is aligned with the opening in the surface and attached to the surface;

n) a first attachment means attached to said first corner member and said first sleeve;

o) a second attachment means attached to said first corner member and said second sleeve such that said first sleeve, said first corner member and said second sleeve are essentially co-planer;

p) said first corner member attached to the surface such that said first sleeve and said second sleeve are positioned to receive said first end of said first vertical support member and said first end of said first horizontal header;

q) a miter corner member configured to receive said second end of said first horizontal header and configured to receive said first end of said second horizontal header, attached to the surface in the opening and slideably engaged with said second end of said first horizontal header and slideably engaged with said first end of said second horizontal header;

r) a third attachment means attached to said second corner member and said third sleeve;

s) a fourth attachment means attached to said second corner member and said fourth sleeve such that said third sleeve, said second corner member and said fourth sleeve are essentially co-planer; and t) said second corner member attached to the surface such that said third sleeve and said fourth sleeve are positioned to receive said second end of said second horizontal header and said first end of said second vertical support member.

4. An apparatus for surrounding an opening in a surface, as described in claim 3 wherein the apparatus is made of non-combustible material.

5. An apparatus for partially surrounding an opening on an external corner in a surface having a plurality of faces, comprising:

a) a first horizontal header having a first end and a second end;

b) a second horizontal header having a first end and a second end;

c) a first alignment means attached to said first horizontal header and attached to the surface such that said first horizontal header is aligned with the opening in the surface and attached to the surface;

d) a second alignment means attached to said second horizontal header and attached to the surface such that said second horizontal header is aligned with the opening in the surface and attached to the surface; and e) a miter corner member configured to receive said second end of said first horizontal header and configured to receive said first end of said second horizontal header attached to the surface in the opening and slideably engaged with said second end of said first horizontal header and slideably engaged with said first end of said second horizontal header.

* * * * *